US010890326B2

(12) United States Patent
Zuzuly et al.

(10) Patent No.: US 10,890,326 B2
(45) Date of Patent: Jan. 12, 2021

(54) FLAME RECTIFICATION CIRCUIT USING OPERATIONAL AMPLIFIER

(71) Applicants: Daniel Zuzuly, Geneva, IL (US); Michael Pietraszak, Hoffman Estates, IL (US)

(72) Inventors: Daniel Zuzuly, Geneva, IL (US); Michael Pietraszak, Hoffman Estates, IL (US)

(73) Assignee: Robertshaw Controls Company, Itasca, IL (US)

( * ) Notice: Subject to any disclaimer, the term of this patent is extended or adjusted under 35 U.S.C. 154(b) by 1068 days.

(21) Appl. No.: 15/339,078

(22) Filed: Oct. 31, 2016

(65) Prior Publication Data

US 2018/0119955 A1 May 3, 2018

(51) Int. Cl.
*F23N 5/12* (2006.01)

(52) U.S. Cl.
CPC ..... *F23N 5/123* (2013.01); *F23N 2229/12* (2020.01); *F23N 2231/04* (2020.01); *F23N 2231/06* (2020.01); *F23N 2231/10* (2020.01); *F23N 2231/12* (2020.01)

(58) Field of Classification Search
CPC . F23Q 23/10; G01R 31/2836; G01R 31/2839; F23N 5/12; F23N 5/123; F23N 2029/12; F23N 2229/12; F23N 2231/04; F23N 2231/06; F23N 2231/10; F23N 2231/12; F23N 5/00; F23N 5/265; G01V 3/02
See application file for complete search history.

(56) References Cited

U.S. PATENT DOCUMENTS 3,348,104 A * 10/1967 Zielinski ..... F23N 5/022 361/173
4,000,961 A * 1/1977 Mandock ..... F23N 5/123 431/2
4,082,493 A 4/1978 Dahlgren
4,235,587 A 11/1980 Miles
4,622,005 A 11/1986 Kurola
4,672,324 A * 6/1987 van Kampen ..... F23N 5/123 307/653
4,695,246 A 9/1987 Beilfuss et al.
4,904,986 A * 2/1990 Pinckaers ..... F23N 5/082 250/554

(Continued)

FOREIGN PATENT DOCUMENTS

CN 101221069 A 7/2008
CN 103336164 A 10/2013
CN 104467709 A 3/2015

*Primary Examiner* — Jorge A Pereiro
(74) *Attorney, Agent, or Firm* — Reinhart Boerner Van Deuren P.C.

(57) ABSTRACT

A method for detecting a flame is provided. The method includes the step of providing alternating current to a flame rectification probe to produce a first voltage as an input for a sense circuit, wherein the flame rectification probe is placed in proximity to the flame. The method further includes the step of conditioning the first voltage using the sense circuit to produce a second voltage. Additionally, the method includes the steps of outputting the second voltage to a microcontroller, and determining with the microcontroller whether the flame is present based on a magnitude of the second voltage.

8 Claims, 5 Drawing Sheets

(56) References Cited

U.S. PATENT DOCUMENTS

| | | | | | |
|---|---|---|---|---|---|
| 5,227,639 | A * | 7/1993 | Sigafus | F23N 5/082 | 250/214 R |
| 5,347,982 | A | 9/1994 | Binzer et al. | | |
| 5,365,223 | A * | 11/1994 | Sigafus | F23N 5/082 | 340/578 |
| 5,472,336 | A * | 12/1995 | Adams | F23N 5/123 | 431/16 |
| 5,775,895 | A * | 7/1998 | Fenn | F23N 5/123 | 431/66 |
| 6,059,195 | A * | 5/2000 | Adams | F23N 5/203 | 236/20 R |
| 6,353,324 | B1 * | 3/2002 | Uber, III | G01R 19/2509 | 324/457 |
| 6,414,318 | B1 * | 7/2002 | Uber, III | G01R 19/2509 | 250/250 |
| 6,501,383 | B1 * | 12/2002 | Haupenthal | F23N 5/123 | 340/577 |
| 6,985,080 | B2 * | 1/2006 | Kociecki | F23N 5/123 | 340/577 |
| 10,132,770 | B2 * | 11/2018 | Branecky | F23N 5/143 | |
| 2004/0174265 | A1 * | 9/2004 | Kociecki | F23N 5/123 | 340/577 |
| 2010/0291494 | A1 * | 11/2010 | Branecky | F23N 5/143 | 431/78 |
| 2012/0288806 | A1 * | 11/2012 | Racaj | F23N 5/123 | 431/18 |
| 2015/0348393 | A1 | 12/2015 | Margolin | | |
| 2016/0274049 | A1 * | 9/2016 | Branecky | F23N 5/143 | |

* cited by examiner

FLAME RECTIFICATION CIRCUIT USING OPERATIONAL AMPLIFIER

FIELD OF THE INVENTION

This invention generally relates to flame detection and more particularly to a device and method that uses flame rectification to detect the presence of a flame.

BACKGROUND OF THE INVENTION

Direct spark ignition (DSI) controls use the principal of flame rectification to determine if a burner flame is present during a call for heat cycle. The DSI controls utilize a flame probe that is designed in such a way that a small DC current will flow in one direction when an AC voltage is applied to the probe. The DSI control then senses this small current to determine if a flame is present. If a flame is not present, the control may do several ignition attempts and then go into a safety shutdown mode to shut off the gas flow.

Since the flame conducts the majority of current only in one direction, the AC voltage developed in the network has a negative bias if current is present and zero bias if there is no flame current. The average DC signal is negative, but the operating range of the DSI circuit is positive (generally between 0V and +5V). This presents a problem with finding a circuit that will operate when the input is beyond the circuit supply voltage range. In addition, the flame current is very low (in the microampere range), so the sensing circuit has to be very high impedance so it does not affect the flame sense signal.

Conventionally, to achieve the two goals (sensing below 0V and high impedance), flame sense circuits used a junction field effect transistor (JFET). JFETs are normally on with zero gate voltage, and they switch off when a negative gate voltage is applied. Additionally, JFETs have very high impedance. However, to sense in the microampere range, the JFET has to be a non-standard, sorted device with a tighter gate threshold voltage. Further, since the introduction of integrated controllers and microcontrollers, the market for discrete JFETs has decreased, and many previous suppliers no longer manufacture these devices. Thus, because the part has to be sorted, satisfactory JFETs have become even more difficult to obtain.

Even if satisfactory JFETs can be found, they still tend to have a wide switching threshold. Generally, the JFETs can have a gate-source cutoff voltage with the maximum value being five times larger than the minimum value. To improve the switching threshold range, the JFETs must be sorted to even tighter tolerances, which makes finding suitable JFETs still more difficult. Additionally, JFETs are only off or on such that the actual flame current level is unknown.

Embodiments of the invention provide a flame sense circuit that is designed to address the disadvantages of conventional JFET flame sense circuits. In particular, the sense circuit employs readily available components that can accept a negative input voltage and output a positive voltage within the range of standard microcontroller devices. Moreover, the sense circuit can provide information about the condition of the flame beyond simply determining whether a flame is present or not. These and other advantages of the invention, as well as additional inventive features, will be apparent from the description of the invention provided herein.

BRIEF SUMMARY OF THE INVENTION

In one aspect, a method for detecting a flame is provided. The method includes the steps of providing alternating current to a flame rectification probe to produce a first voltage as an input for a sense circuit. The flame rectification probe is placed in proximity to the flame. The method also includes the steps of conditioning the first voltage using the sense circuit to produce a second voltage, outputting the second voltage to a microcontroller, and determining with the microcontroller whether the flame is present based on a magnitude of the second voltage.

In embodiments of the method, the step of conditioning the first voltage includes the steps of reversing the polarity of the first voltage and modifying the magnitude of the first voltage.

In another embodiment of the method, the step of conditioning the first voltage is performing using an operational amplifier. In such an embodiment, the method can include the additional step of performing a component fault check to determine if any of the components of the sense circuit have failed. In a further embodiment, the sense circuit includes an operational amplifier and performing a component fault check includes providing a flame check reset circuit and providing a flame check gain circuit. The flame check reset circuit is operably connected to an inverting input of the operational amplifier and wherein the flame check gain circuit is operably connected to a non-inverting input of the operational amplifier. Still further, the method can further include the steps of sending a first signal from the flame check reset circuit such that the inverting input of the operational amplifier senses a positive voltage and outputting a zero voltage from the sense circuit to the microcontroller. The microcontroller detects a component fault if an output voltage other than zero is provided by the sense circuit.

In another embodiment, the component fault check further includes the steps of sending a first signal from the flame check reset circuit such that the inverting input of the operational amplifier senses a positive voltage, sending a second signal from the flame check gain circuit such that the non-inverting input of the operational amplifier senses an input voltage, and outputting a differential voltage from the sense circuit to the microcontroller. The microcontroller detects a component fault if the differential voltage does not match an expected differential voltage.

In a particular embodiment, the step of providing a flame check reset circuit further comprises providing a flame check reset circuit including a PNP transistor. Further, an emitter of the PNP transistor can be connected to a circuit rail voltage. A base of the PNP transistor can be connected to a reset input in which the reset input is capable of providing a reset signal, and a collector of the PNP transistor can be connected to the inverting input of the operational amplifier. During the step of determining whether a flame is present, the reset signal can be provided to the base of the PNP transistor such that the PNP transistor enters a cutoff mode.

In another aspect, a flame sense circuit configured to receive a first voltage produced by an AC signal source and a flame rectification probe is provided. The flame sense circuit includes an operational amplifier having an inverting input adapted to receive the first voltage, a non-inverting input, and an output. The flame sense circuit also includes a first resistor (R1) connected on a negative feedback loop between the output and the inverting input of the operational amplifier, and a second resistor (R2), R2 being connected to the inverting input. The flame sense circuit further includes a microcontroller configured to detect a second voltage from the output of the operational amplifier.

In embodiments of the flame sense circuit, the first voltage is negative in polarity and has a first magnitude when a flame is present at the flame rectification probe. Further still, the second voltage can be positive in polarity and has a second magnitude that is smaller than the first magnitude. Moreover, the second magnitude of the second voltage can be approximately equal to R2/R1 multiplied by the first magnitude of the first voltage.

In other embodiments, the flame sense circuit further comprises a flame check reset circuit. The flame check reset circuit includes a transistor having a base, a collector, and an emitter in which the collector is operably connected to the inverting input of the operational amplifier. A flame check reset output provides a third voltage to the base of the transistor, and a fourth voltage is supplied to the emitter. The transistor operates in the cut-off mode when the third voltage is higher than the fourth voltage, and while the transistor is in the cut-off mode, the second voltage of the operational amplifier that is output to the microcontroller depends on the presence and quality of the flame. The transistor operates in the forward-active mode when the third voltage is less than the fourth voltage, and while the transistor is in the forward-active mode, the second voltage of the operational amplifier is compared to a predetermined reset check expected voltage in the microcontroller to determine if a component has failed.

In embodiments, the flame sense circuit also includes a flame check gain circuit. The flame check gain circuit can include a flame check gain output that provides a fifth voltage to the non-inverting input of the operational amplifier while the transistor is in the forward-active mode. In such an embodiment, the second voltage of the operational amplifier can be compared to an expected gain check voltage in the microcontroller to determine if a component has failed.

In other embodiments of the flame sense circuit, R2/R1 is less than 1. In still other embodiments of the flame sense circuit, a first capacitor is placed in parallel to R2 on the negative feedback loop. In yet another embodiment of the flame sense circuit, a second capacitor is operably connected between a node in common with R1 and ground. The flame sense circuit of claim 11, wherein the second voltage output by the operational amplifier is constrained to a rail voltage of the microcontroller.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

In general, a flame sense circuit including an operational amplifier is provided. Using the operational amplifier, the flame sense circuit is able to invert the negative input voltage resulting from flame rectification of the AC signal at the flame probe. Additionally, by adjusting the gain of the operational amplifier, the sense circuit can output to a microcontroller a signal that is within the typical rail voltage of the microcontroller. Further, the gain of the operational amplifier can be manipulated such that the output signal varies linearly with the flame current. As such, the microcontroller can determine not only whether a flame is present but also what the condition of the flame is. While described primarily in the context of a sense circuit for a burner, a person having ordinary skill in the art will appreciate from the disclosure that the flame sense circuit is applicable in other applications.

Figure 1:
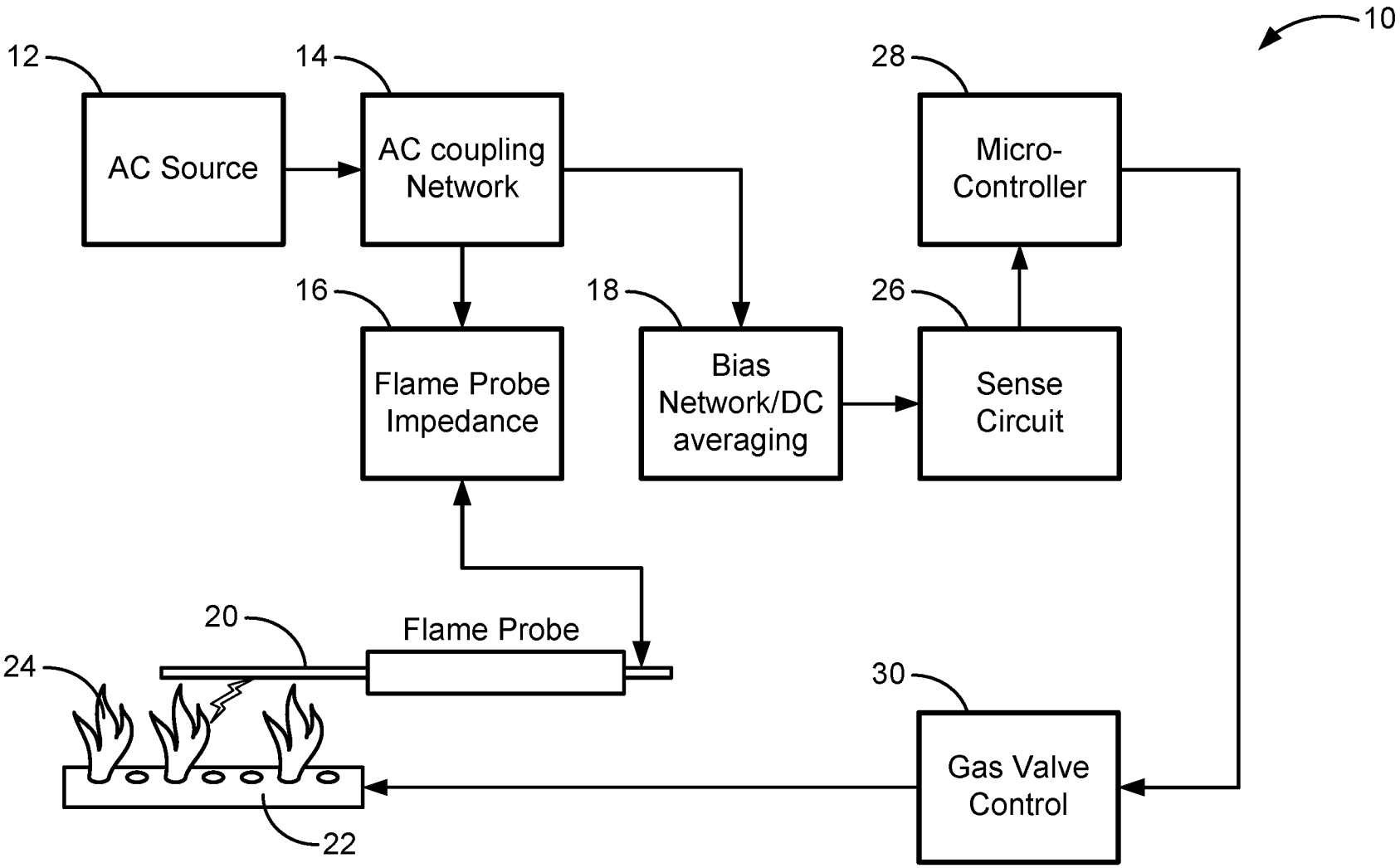
FIG. 1 is a flame sense block diagram depicting the components of the flame rectification circuit according to an exemplary embodiment.

In order to provide an overall context for the flame sense circuit within an ignition control system, FIG. 1 provides a flame sense block diagram 10. In the flame sense block diagram 10, an AC source 12 provides the initial signal for operating the ignition control system. Via an AC coupling network 14 that includes a capacitor, the AC source 12 is connected to a flame probe impedance circuit 16 and a bias network 18 that provides DC averaging. The flame probe impedance circuit 16 is connected to a flame probe 20 that is placed in proximity to a burner 22. The flame probe 20 is placed in such proximity to the burner 22 that, when the burner 22 is lit, the flame probe 20 is disposed within the flame 24. Because of flame rectification when a flame 24 is present at the burner 22, only positive current from the AC source 12 is passed through the flame 24. This results in a net negative voltage accumulating at the capacitor of the AC coupling network 14. The magnitude of the voltage at the AC coupling network 14 depends on the size and quality of the flame. The bias network 18 averages this negative DC voltage from the AC coupling network 14.

The bias network 18 is operably connected to a sense circuit 26. In turn, the sense circuit 26 is operably connected to a microcontroller 28, which controls the gas valve 30 for the burner 22. The negative DC voltage detected by the sense circuit 26 is communicated to the microcontroller 28. Since the voltage sensed by the sense circuit 26 is generally large in magnitude and negative in polarity, the sense circuit 26 does not communicate this sensed voltage directly to the microcontroller 28. Instead, the sense circuit 26 reduces the magnitude of the voltage to the magnitude of the rail voltage of the microcontroller 28 and switches the polarity from negative to positive. Typically, the voltage detected will be between −25V and 0V. For example, when no flame 24 is present, the voltage will be 0V, and when a particularly robust flame 24 is present, the voltage can be up to approximately −25V.

Once the sensed voltage is inverted and reduced to the desired microcontroller input voltage, the microcontroller 28 determines the status of the flame 24 at the burner 22 based on the voltage received. Depending on whether the voltage received indicates that a flame is present or not, the microcontroller will attempt to ignite the gas at the burner 22 if no flame is sensed or simply monitor the condition of the flame 24 if a flame 24 is sensed. If no flame 24 is sensed after a predetermined number of ignition attempts and/or after a predetermined amount of time, the microcontroller 28 will signal a gas valve control 30 to shut off the flow of gas to the burner 22 to allow any accumulated gas to dissipate.

Figure 2:
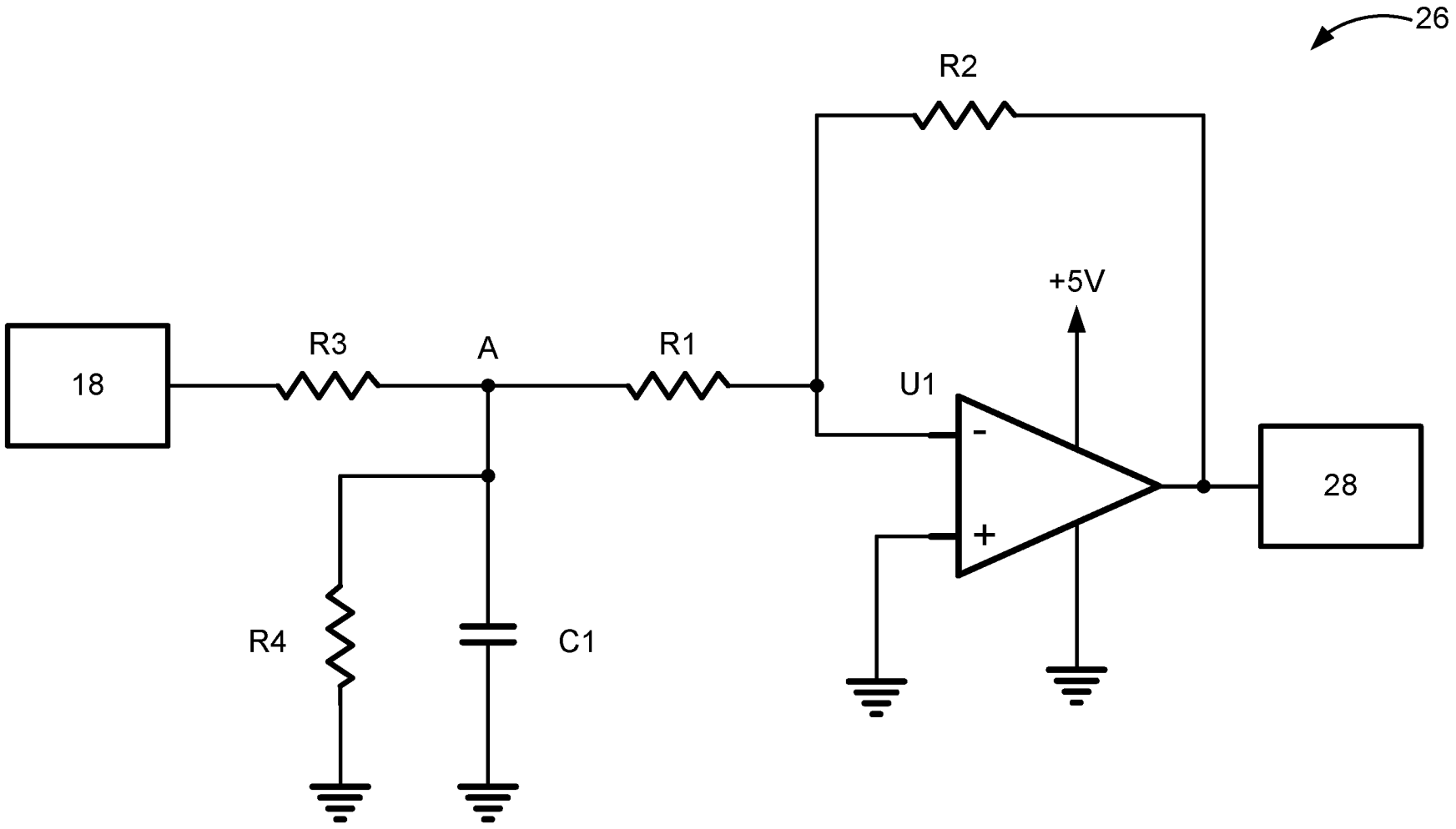
FIG. 2 is a basic configuration of the sense circuit of the flame rectification circuit according to an exemplary embodiment.

A basic configuration of the sense circuit 26 is provided in FIG. 2. As can be seen, the sense circuit 26 utilizes an operational amplifier ("op-amp") U1 to invert the incoming voltage signal to a positive voltage while reducing the voltage to the rail voltage of the microcontroller 28. Resistors R3, R4 and capacitor C1 form a voltage divider bias circuit such that the voltage at node A is between −25V and 0V. The capacitor C1 helps eliminate power supply and pick-up noise that could be coupled into the sense circuit 26. Resistor R1 helps set the op-amp gain and limits the magnitude of the current entering the op-amp U1. Resistor R1 also provides a known high impedance load for the bias network 18. As shown in FIG. 2, the input voltage enters the inverting input of the op-amp U1, which causes the op-amp U1 to invert the signal. In the basic configuration of the sense circuit 26 shown in FIG. 2, the non-inverting input of the op-amp U1 is connected to ground. Further, as shown in FIG. 2, the power supply pins of the op-amp U1 limit the output of the op-amp U1 to the rail voltage of the microcontroller 28. In FIG. 2, the op-amp U1 is provided with negative feedback by coupling resistor R2 to the inverting input of the op-amp U1. In this way, the gain of the op-amp U1 is set by the ratio of resistor R2 to R1 (i.e., gain=R2/R1). In the embodiment depicted, the input voltage is larger in magnitude than the rail voltage, and therefore, the gain of the op-amp U1 is designed to be less than one for this embodiment.

Exemplary components usable in one embodiment of the basic configuration circuit of FIG. 2 are summarized in Table 1. As mentioned above, the gain of the op-amp U1 is less than one for the sense circuit 26 depicted in FIG. 2. In an exemplary embodiment, resistor R1 is selected to be 10 MΩ and resistor R2 is selected to be 4.7 MΩ. Thus, the gain of the op-amp U1 is 0.274. Accordingly, for example, an input voltage of −10V will result in an output voltage $V_{out}$ of 2.74V. The gain can be adjusted to give a linear output over the desired range, i.e., for the typical input range of −25V to 0V. The output voltage $V_{out}$ can then sent to an analog-to-digital converter (not shown) of the microcontroller 28 to get a digital representation of the flame sense current. For the sense circuit 26 depicted in FIG. 2, the output is linear for flame currents of 0 μA to 3.6 μA. Based on the output, and the threshold and hysteresis levels for a flame present condition can be determined in software.

TABLE 1

| Exemplary Components of Basic Flame Sense Circuit | |
|---|---|
| R1 | 10 MΩ |
| R2 | 2.74 MΩ |
| R3 | 4.7 MΩ |
| R4 | 10 MΩ |
| C1 | 47 nF |
| U1 | TI OP347 or MCP601 |

The sense circuit 26 depicted in FIG. 2 has several properties. Initially, as mentioned above, the input bias current is kept low (in the nanoampere range) so that leakage currents do not affect readings. Further, the input common mode range is below zero (−0.3V) because the input is at virtual ground (0V). The output is rail-to-rail, i.e., the sense circuit 26 has a typical output range of 0V to 5V. In further embodiments, the sense circuit 26 is characterized by other properties. For instance, in preferable embodiments, the op-amp input pins have phase reversal protection in case the inputs go below zero. In such a case without phase reversal protection, the op-amp U1 could invert the output, which could cause a false signal level. In a further preferably embodiment, the op-amp input clamps at −0.7V and handles small input current (<10 μA) without any detrimental effects if the input pin goes below zero volts.

Figure 3:
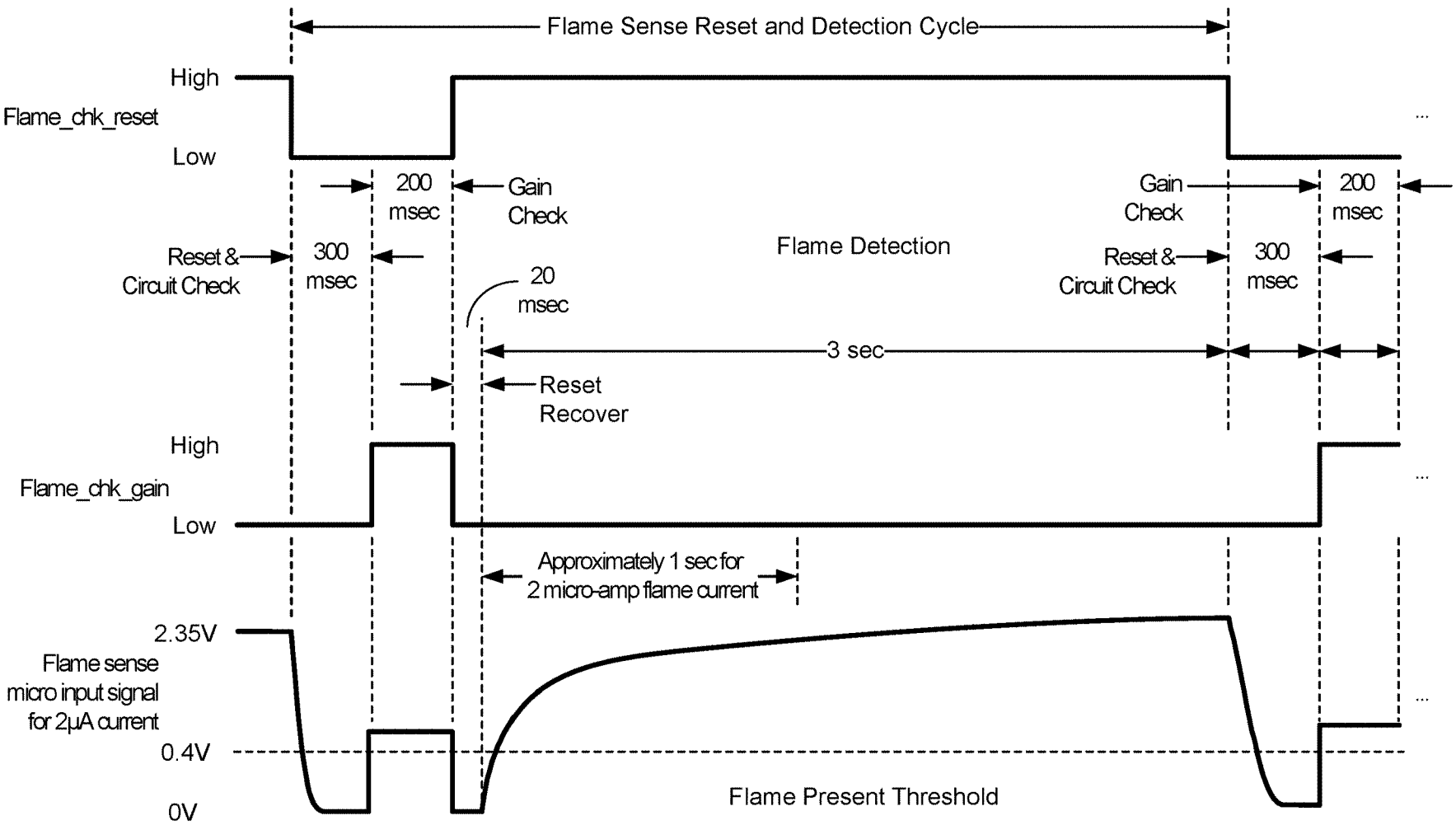
FIG. 3 is a control diagram depicting the timing for the component fault detection method according to an exemplary embodiment.

In a further embodiment of the sense circuit 26, the sense circuit 26 is preferably capable of performing a component fault detection method. A control diagram for performing the component fault check method is provided in FIG. 3. The control diagram considers a flame sense input signal resulting from a flame current of 2 μA, which results in approximately a 2.35V output for the flame sense circuit 26 (i.e., output of the op-amp U1). As can be seen in FIG. 3, normal operation of the burner occurs with the flame_chk_gain set low and the flame_chk_reset set high. When flame_chk_reset goes low, the negative flame input voltage signal gets reset to positive 1V, which sets the output of the op-amp U1 to 0V. When flame_chk_gain goes high and flame_chk_reset is low, the op-amp U1 then acts as a difference amplifier, resulting in an output of the op-amp U1 of approximately 1.2V (for the exemplary configuration of the circuit). By using these checks, component faults can be detected if the op-amp U1 does not output the expected value, and the control will go into a lockout or safe condition if a fault occurs. As shown in FIG. 3 for the exemplary embodiment, a flame is determined to be present if the signal is above 0.4V. FIG. 3 also provides exemplary times for the flame_chk_reset, flame_chk_gain, and flame detection timers.

Figure 4:
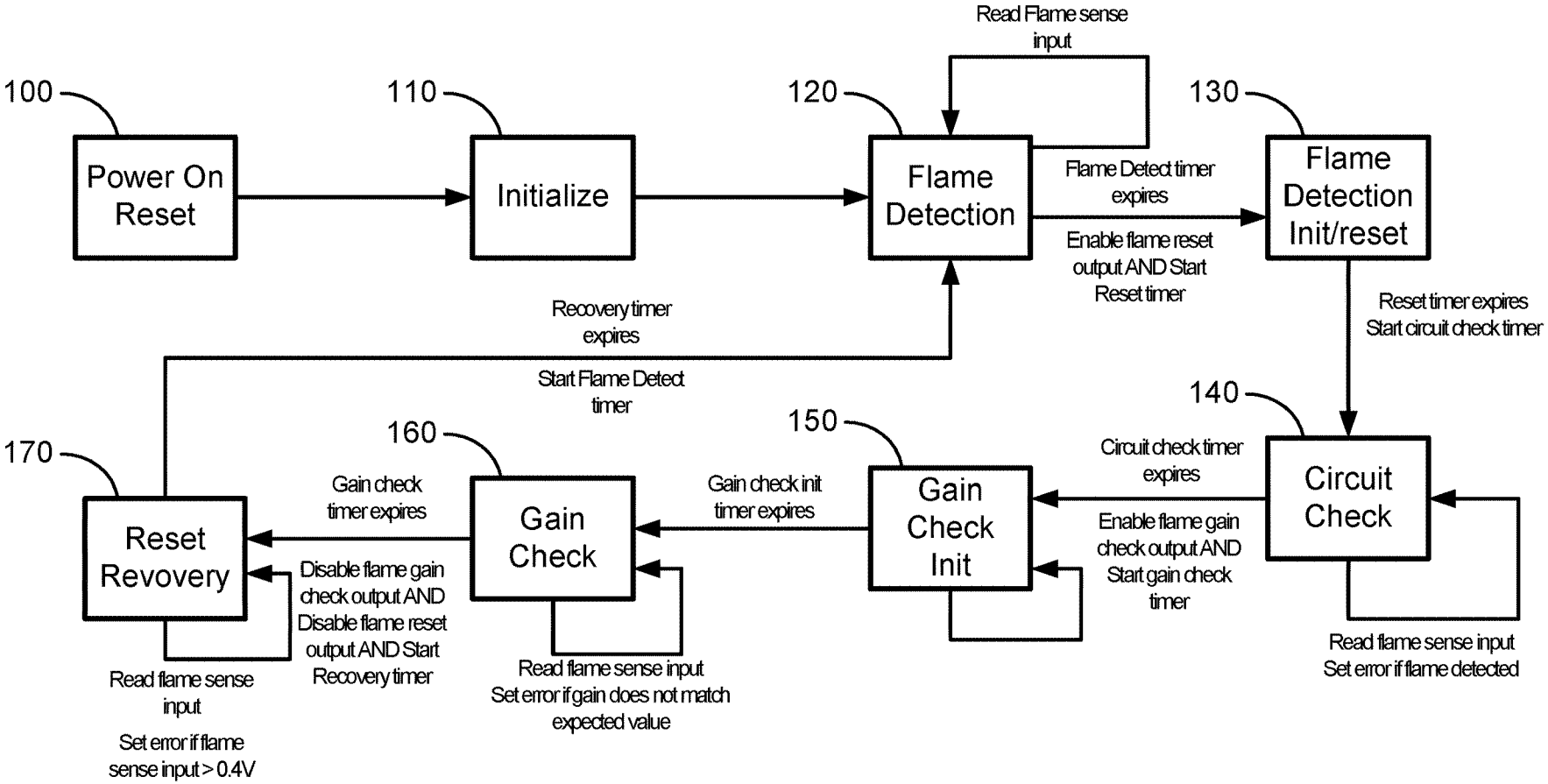
FIG. 4 is a state diagram of a component fault detection method for the flame rectification circuit according to an exemplary embodiment.
Figure 5:
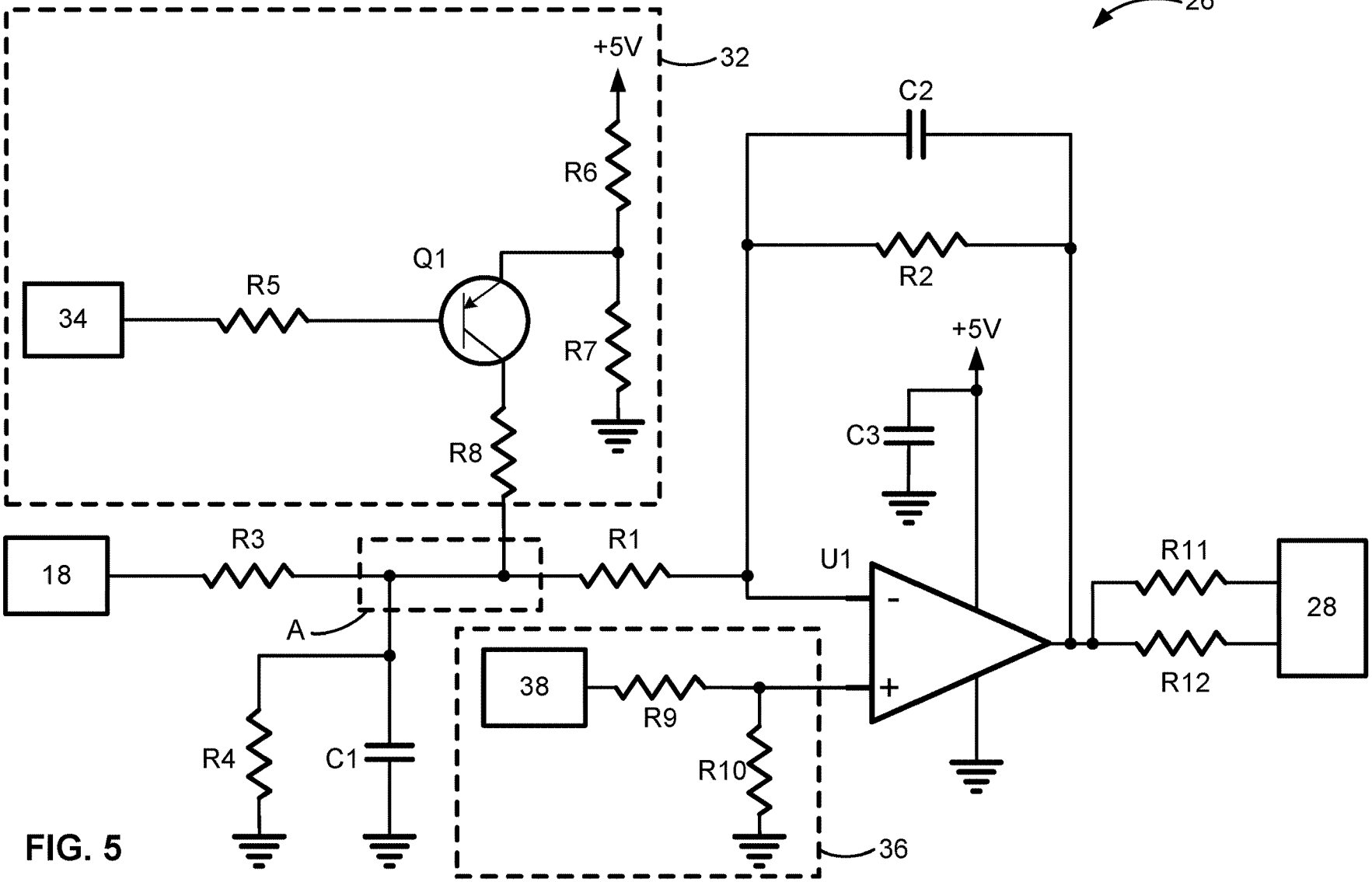
FIG. 5 is a schematic representation of a portion of the flame rectification circuit that includes circuits for performing the component fault detection method according to an exemplary embodiment.

The component fault detection method is also illustrated schematically in the state diagram provided in FIG. 4. The flow diagram begins with step 100 in which power is provided to the system. At that time, the flame detection status and check timers are reset. In step 110, the system is initialized to begin detecting a flame and to begin performing the component checks. In step 120, flame detection begins, and the flame sense input from the sense circuit 26 (as shown in FIG. 5, discussed below) is read. Flame detection is performed until the flame detection timer expires. At that time, the flame_chk_reset output 34 (FIG. 5) is enabled and the reset timer is started. In step 130, the reset timer expires, and the circuit check timer begins. In step 140, the circuit check is performed. During the circuit check, the flame sense input is read, and if a flame is detected, an error is set. Referring back to FIG. 3, during the circuit check, no flame should be sensed because the signal should be 0V as shown in the bottom portion of the control diagram.

As shown in FIG. 4, after the circuit check timer expires, the flame_chk_gain output 38 (FIG. 5) is enabled and the gain check timer begins. In step 150, the gain check is initialized. When the gain check initialization timer expires, the gain check occurs in step 160. During the gain check, the flame sense input is read, and an error is set if the gain does not match the expected value. As discussed above with respect to the exemplary embodiments, a value of approximately 1.2V is expected when flame_chk_gain is high and flame_chk_reset is low. This condition is also depicted in the bottom control diagram of FIG. 3. Returning to FIG. 4, the flame_chk_gain output 38 (FIG. 5) and the flame_chk_reset output 34 (FIG. 5) are disabled after the gain check timer expires, and the recovery timer is started. Then, in step 170, the reset recovery takes place. During this step, the flame sense input is read, and an error is set if the flame sense input is greater than a predetermined voltage. When the recovery timer expires, the reset recovery step 170 concludes, and the flame detect timer begins. The method then returns to the flame detection step 120. As stated above, by performing this component check method, the controller can monitor the flame status and determine if a component has failed based on whether the output of the sense circuit 26 (FIG. 5) matches the expected output.

FIG. 5 depicts the flame sense circuit 26 of the ignition control system including components to perform the component fault check method described above. As can be seen in FIG. 5, the components of the basic configuration of the sense circuit 26 are still present. The flame_chk_reset portion 32 of the sense circuit 26 is added at node A of the sense circuit 26. The flame_chk_reset portion 32 includes a PNP transistor Q1 with a base connected to the flame_chk_reset output 34 and resistor R5. The emitter is connected between resistor R6 and resistor R7. Resistor R6 is connected to the rail voltage, and resistor R7 is connected to ground. Because of the split resistor biasing, the voltage at the emitter will be the rail voltage multiplied by R7/(R6+R7). Resistor R8 is provided on the connection between the collector of transistor Q1 and node A of the flame sense circuit. As discussed above, the flame_chk_reset output 34 is high during normal operation. In that condition, the base voltage is higher than both the emitter and collector voltage, which puts the transistor Q1 in the cut-off mode. As such, the voltage at the inverting input of the op-amp U1 will be the voltage from the bias network 18, which is typically between −25V and 0V.

As also shown in FIG. 5, the flame_chk_gain portion 36 of the sense circuit 26 is connected to the non-inverting input of the op-amp U1. Specifically, the non-inverting input of the op-amp U1 is connected between resistor R9 and resistor R10. The voltage at the non-inverting input of the op-amp U1 is the voltage derived from the split resistor biasing of the source voltage, i.e., the flame_chk_gain output 38, and ground. As discussed above, the flame_chk_gain output 38 is zero during normal operation, so the voltage at the non-inverting input is also zero during normal operation.

Capacitor C2 provides filtering of the negative feedback through resistor R2. Filtering is also provided by capacitor C1. Advantageously, the combination of filtering from capacitors C1 and C2 provides quicker filtering and faster response times to flame status than using just a single, larger capacitor C1. Capacitor C3 also provides filter of the source voltage for the op-amp U1 so as to avoid ripples in the power supply to the op-amp U1 such that the op-amp U1 is able to accurately output a voltage to the microcontroller 28.

The voltage output of the op-amp U1 is provided to the microcontroller 28. As shown in FIG. 5, the output of the op-amp U1 is split between a first path having resistor R11 and a second path having resistor R12. The paths are redundant, and in other embodiments, a single path or three or more paths could also be provided. Using these paths, the microcontroller 28 receives a signal that corresponds to the presence of the flame as well as the condition of the flame. In an embodiment, the output of the op-amp U1 scales linearly between 0V and 5V for a flame current of up to 3.6 μA. In this way, the sense circuit 26 is able to convert a large, negative voltage created by flame rectification in a DSI control system into a signal usable by the microcontroller 28 to provide more information about the flame at a burner than conventional DSI control systems.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise No language in the specification should be construed as indicating any non-claimed claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A flame sense circuit configured to receive a first voltage produced by an AC signal source and a flame rectification probe, the flame sense circuit comprising:

an operation amplifier having an inverting input adapted to receive the first voltage, a non-inverting input, and an output;

a first resistor (R2) connected on a negative feedback loop between the output and the inverting input of the operational amplifier;

a second resistor (R1), (R1) being connected to the inverting input;

a microcontroller configured to detect a second voltage from the output of the operational amplifier to determine whether a flame is present at the flame rectification probe; and a flame check reset circuit, the flame check reset circuit comprising:

a transistor having a base, a collector, and an emitter, wherein the collector is operably connected to the inverting input of the operational amplifier; and a flame check reset output that provides a third voltage to the base of the transistor;

wherein a fourth voltage is supplied to the emitter;

wherein the transistor operates in the cut-off mode when the third voltage is higher than the fourth voltage and, while the transistor is in the cut-off mode, the second voltage of the operational amplifier that is output to the microcontroller depends on the presence and quality of the flame; and wherein the transistor operates in the forward-active mode when the third voltage is less than the fourth voltage and, while the transistor is in the forward-active mode, the second voltage of the operational amplifier is compared to a predetermined reset check expected voltage in the microcontroller to determine if a component has failed.

2. The flame sense circuit of claim 1, further comprising a flame check gain circuit, the flame check gain circuit comprising:

a flame check gain output that provides a fifth voltage to the non-inverting input of the operational amplifier while the transistor is in the forward-active mode;

wherein the second voltage of the operational amplifier is compared to an expected gain check voltage in the microcontroller to determine if a component has failed.

3. A method for detecting a flame, the method comprising the steps of:

providing alternating current to a flame rectification probe to produce a first voltage as an input for a sense circuit, wherein the flame rectification probe is placed in proximity to the flame;

conditioning the first voltage using the sense circuit to produce a second voltage;

outputting the second voltage to a microcontroller, and determining with the microcontroller whether the flame is present based on a magnitude of the second voltage;

wherein the step of conditioning the first voltage is performed using an operational amplifier;

wherein the method further comprises the step of performing a component fault check to determine if any of the components of the sense circuit have failed;

wherein the sense circuit comprises an operational amplifier and wherein step of performing a component fault check comprises:

providing a flame check reset circuit; and providing a flame check gain circuit;

wherein the flame check reset circuit is operably connected to an inverting input of the operational amplifier and wherein the flame check gain circuit is operably connected to a non-inverting input of the operational amplifier.

4. The method of claim 3, further comprising the steps of:

sending a first signal from the flame check reset circuit such that the inverting input of the operational amplifier senses a positive voltage; and outputting a zero voltage from the sense circuit to the microcontroller, wherein them microcontroller detects a component fault if an output voltage other than zero is provided by the sense circuit.

5. The method of claim 4, further comprising, the steps of:

sending a first signal from the flame check reset circuit such that the inverting input of the operational amplifier senses a positive voltage;

sending a second signal from the flame check gain circuit such that the non-inverting input of the operational amplifier senses an input voltage; and outputting a differential voltage from the sense circuit to the microcontroller, wherein the microcontroller detects a component fault if the differential voltage does not match an expected differential voltage.

6. The method of claim 5, wherein the step of providing a flame check reset circuit further comprises providing a flame check reset circuit including a PNP transistor.

7. The method of claim 6, further comprising the steps of:

connecting an emitter of the PNP transistor to a circuit rail voltage;

connecting a base of the PNP transistor to a reset input, the reset input capable of providing a reset signal; and connecting a collector of the PNP transistor to the inverting input of the operational amplifier.

8. The method of claim 7, wherein during the step of determining whether a flame is present, the reset signal is provided to the base of the PNP transistor such that the PNP transistor enters a cutoff mode.

* * * * *